United States Patent [19]

Rose

[11] Patent Number: 4,697,287

[45] Date of Patent: Oct. 6, 1987

[54] PROTECTIVE COVERING FOR AN ADULT AND CHILD DURING FEEDING OF THE CHILD

[76] Inventor: James N. Rose, 2435 Biscayne Bay Dr., Miami, Fla. 33181

[21] Appl. No.: 937,699

[22] Filed: Dec. 4, 1986

[51] Int. Cl.[4] ..... A41B 13/10; A41B 1/20

[52] U.S. Cl. ..... 2/49; 2/104

[58] Field of Search ..... 2/49, 48, 104

[56] References Cited

U.S. PATENT DOCUMENTS 2,431,052 11/1947 La Gier ..... 2/49

2,857,599 10/1958 Wallace ..... 2/49

*Primary Examiner*—Doris L. Troutman

*Attorney, Agent, or Firm*—John Cyril Malloy

[57] ABSTRACT

A protective covering specifically designed to be draped over and thereby protect an adult during the feeding of the infant. The structure includes a base specifically dimensioned and configured to embrace or at least partially surround both the neck of the adult and the child being held for feeding such that a panel portion of the base serves to at least partially cover a frontal area of the infant while connected to and extending over a frontal portion of the adult. Structure of the base is further provided to adequately cover and protect both the adult and infant regardless of the infant being supported on the adult on either the right side or the left side thereof.

8 Claims, 5 Drawing Figures

PROTECTIVE COVERING FOR AN ADULT AND CHILD DURING FEEDING OF THE CHILD

BACKGROUND OF THE INVENTION

This invention relates to a protective cover designed to protect the clothes and person of both an adult and infant during the feeding of an infant while being held by the adult wherein the base of the protective covering is specifically structured to engage concurrently both the adult and the infant.

DESCRIPTION OF THE PRIOR ART

In the process of feeding infant, it is common practice for an adult to hold the infant in one arm or the other, and with the other hand support and feed the infant by means of a baby bottle or like facilities. During the feeding process and because of the "inexperience" of the infant, soiling of the clothes of the infant and of the adult "supervising the feeding" is a frequent occurrence. Also, clothing of either the adult or the infant become soiled when "burping" of the infant occurs or during periods of regurgitation. Naturally, soiling of the personal clothing of the infant and adult in the situation referred to above is extremely undesirable both from the standpoint of staining the clothing involved and the unpleasantness of such events occurring in situations where the clothing of either the infant of the adult cannot be readily changed or cleaned.

In order to overcome the problems of the type referred to, the adult frequently uses towels, diapers, or any readily available cloth or like structure to serve as a protective covering. However, do to the specific design configuration of such normal "household" items, adequate covering of both the adult and the child, concurrently, is usually difficult. In addition and again for the reasons set forth above, it is important that both the frontal portion of the adult and a certain portion of the shoulders and upper back of the adult be covered in that the feeding process of the infant frequently involves burping, with the attendant problem associated therewith.

Therefore, in order to overcome the above set forth problems, the prior art includes the design of various types of coverings which generally are structured and configured to protect the adult more than the infant's clothing, and also, generally do not provide structure for concurrent attachment both to the adult and the infant in a preferred fashion. Such prior art designs are represented in the U.S. patents to Breck, U.S. Pat. No. 2,114,589; LaGier, U.S. Pat. No. 2,431,052; Murray, U.S. Pat. No. 2,640,197; Schmidt, U.S. Pat. No. 2,665,426; LaDaux, U.S. Pat. No. 2,682,055; Simon, U.S. Pat. No. 2,727,239; Wallace, U.S. Pat. No. 2,857,699; Scharf, U.S. Pat. No. 4,564,957; Savin, et al., U.S. Pat. No. 4,475,250. While the structures of the type disclosed in the above set forth U.S. patents are applicable and operable for their intended function, there is still a need in this area for a protective covering which adequately engages, concurrently, both the infant and the adult, while at the same time covering at least the frontal portion of the infant while covering the frontal and rear portion of the adult.

SUMMARY OF THE INVENTION

The present invention relates to a protective covering structure specifically designed to protect the clothes and person of an adult and of an infant while the adult is feeding the infant and at the same time holding and supporting the infant during the feeding process. The base preferably is made from a cloth or like flexible material having a front face being formed of liquid absorbent material and which, of course, is washable, in at least one embodiment, so as to allow reuse of the structure. Another embodiment would be a disposable, flexible material base designed to be disposed of after a single use.

The base comprises an aperture formed in the base in spaced relation from oppositely disposed transverse ends and inwardly from longitudinal sides of the base. A first portion of the base extends what may be considered rearwardly from the aperture to a first of the transverse ends of the base a sufficient distance to cover the upper shoulders and extend down to at least the shoulder blade area of the adult, when the aperture is disposed in surrounding relation to the neck of the adult. Similarly, the base includes a second portion representing a covering for the frontal area of the adult. The second portion extends from the aperture surrounding the neck of the adult down to a second transverse end a sufficient distance to position the second transverse end substantially adjacent to the waist area.

An important feature of the present invention is at least one but preferably two cut-out portions formed adjacent or contiguous to the second transverse end of the base. More specifically, an elongated slit is formed in the base and extends from the aperture down to the second transverse end so as to define two separable and relatively moveable panels of the second portion. In a preferred embodiment, to be described in further detail hereinafter, each of the panels include one of the aforementioned cut-out portion designed to engage and surround the neck of the infant concurrently to the aperture of the base surrounding the neck of the adult.

The length of each panel is sufficient to provide adequate covering for both the frontal areas of the infant and adult. The provision of two cut-out portions, each being in a separable and moveable panel, allows the infant to be carried, cradled or supported in either arm while the bottle or feeding device is supported and administered by the free hand. Accordingly, an adult being either right handed or left handed could still utilize the subject protective covering by "interconnecting" the infant to an appropriately positioned cut-out portion associated with either the right or left panel once the base is placed in draped position about the shoulders, upper back and frontal portion of the adult.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a full understanding of the nature of the present invention, reference should be had to the following detailed description taken in connection with the accompanying drawing in which.

Like references are used to refer to like parts throughout the use of the drawings.

DETAILED DESCRIPTION OF PREFERRED EMBODIMENT

Figure 1:
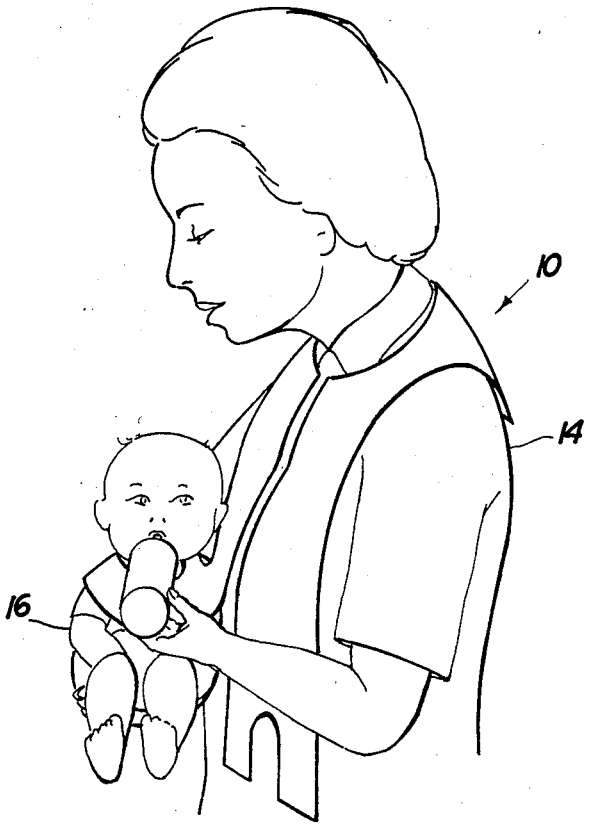
FIG. 1 is a perspective view of an adult, carrying an infant with the protective covering resembling the present invention mounted on and connected to both.
Figure 2:
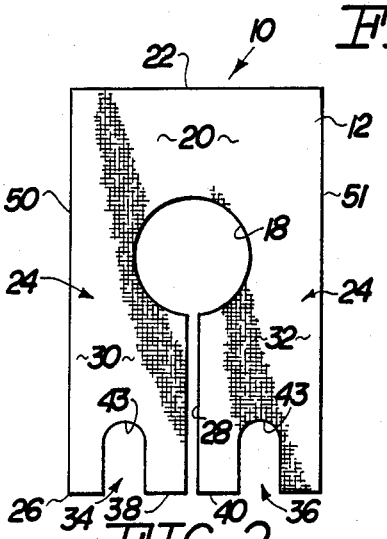
FIG. 2 is a front elevation of one embodiment of the present invention.
Figure 3:
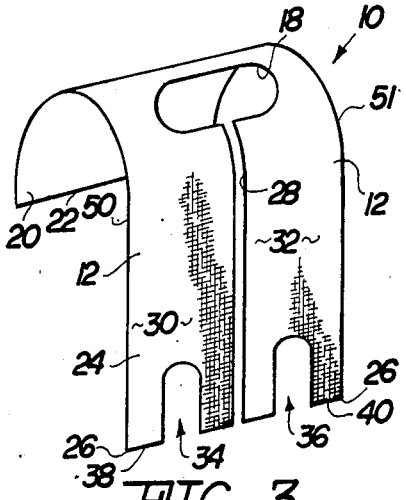
FIG. 3 is a perspective view of the embodiment of FIG. 2 shown in a substantially protective orientation without being mounted on the adult or infant.

As shown in FIGS. 1 through 3, the present invention is directed toward a protective covering structure generally indicated as 10, and including a base 12 specifically dimensioned, designed and configured, to concurrently engage and be draped over, in a protective fashion, an adult 14 and an infant 16 in a manner which concurrently engages both and protects at least a frontal area of both in a manner which will be described in further detail hereinafter. Primarily with reference to FIGS. 2 and 3, the base 12 includes an aperture 18 which combined with the embodiment shown in FIG. 2 has a substantially circular or round peripheral configuration so as to fit in surrounding relation about the neck of the adult 14 feeding the infant 16. The base 12 includes a first portion 20 extending from the aperture 18 longitudinally to a first transverse end 22. The length or the distance of extension of the first portion of the base 20 between the aperture 18 and the first transverse end 22 is sufficient to at least extend the first portion in substantial registry with the shoulder blades of the adult 14 as generally shown in FIG. 1.

Similarly, the base 12 includes a second portion 24 extending from the aperture 18 to the opposite transverse end 26 a sufficient distance to at least cover the frontal portion of the adult substantially from the neck to the waist also as generally shown in FIG. 1.

An elongated slit 28 extends continuously between and in communication with the aperture 18 and the second transverse end 26. This slit 28 passes completely through the second portion 24 thereby serving to define two relatively moveable and separable panels 30 and 32. In a preferred embodiment each of the panels include a separate cut-out portion generally indicated as 34 and 36, respectively.

The cut-out portions 34 and 36 extend inwardly from respective end portions 38 and 40 of the panels 30 and 32 to a somewhat curvalinear end 43 wherein such cut-out portions, 34 and 36 and the various portions thereof, are specifically disposed, dimensioned and configured to at least partially surround or engage the neck of the infant and extend outwardly therefrom in overlying and protect relation to the frontal portion of the infant while the base 12 is secured to the adult 14. The securement of the base 12 to the adult 14 occurs by the aperture 18 being disposed in surrounding relation to the neck of the adult.

Further, the provision of two cut-out portions 34 and 36 allows the child to be supported on either side by either arm of the adult and when so positioned, the correspondingly disposed cut-out portion 34 and 36, depending upon the side of the adult on which the infant is supported, is usable. The existence of the extended length of the first portion 20 provides adequate protective covering for the shoulders and upper back area of the adult 14 during burping or effectively supporting or carrying the child, after feeding, over the shoulders of the adult.

Figure 4:
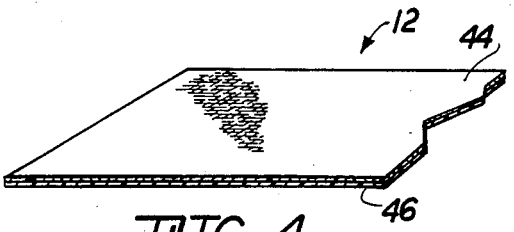
FIG. 4 is a sectional view in partial cut-away showing a structural embodiment of the base and the material from which it is formed.
Figure 5:
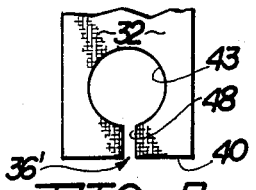
FIG. 5 shows another embodiment of the protective covering of the present invention.

With regard to FIG. 4, the material from which the base 12 is formed can be an outer, liquid-absorbent material 44 such as terry cloth or the like, secured to the a substantially liquid impermeable material 46 defining an underlayer of the base 12 and structured and disposed to prevent liquid from passing there through, and staining the clothing of either the infant or the adult.

In another embodiment of the present invention, either or both of the cut-out portions, as shown in FIG. 6, and generally represented as 36', may include a substantially round or circular end 43' communicating with a corresponding end portion 40 of the respective panel 32 by an elongated slit 48 which of course, differs in dimension and location from the elongated slit 28 separating the panels 30 and 32 as best shown in FIG. 2. The provision of slit 48 is to, of course, properly position the larger aperture 43 in surrounding relation to the neck of the infant 16.

Regardless of the embodiment utilized, it is further noted that the transverse dimensions of the base 12 as substantially between the longitudinal sides 50 and 51 may be substantially consistent throughout the length of the base 12 and also is sufficient to properly drape over the shoulders, upper back and frontal portions of the adult 14 generally in the manner represented in FIG. 1.

What is claimed is:

1. A protective covering structure for both an adult and infant during feeding of the infant, since structure comprising:

a. a base formed of flexible material and having a substantially elongated configuration terminating at oppositely exposed transverse ends, b. an aperture formed in said base and including a periphery dimensioned to at least partially surround the neck of the adult, c. said aperture spaced from said transverse ends and disposed inwardly from oppositely disposed longitudinal sides of base, d. said base including a first portion extending from said aperture to a first of said transverse ends a sufficient distance to dispose said first transverse end at least in alignment with the shoulder blades of the adult, e. said base including a second portion extending from said aperture a sufficient distance to dispose said second transverse end substantially adjacent at the waist of the adult, f. said first and said second portions including a transverse dimension sufficient to dispose said base in a draped orientation over the shoulders of the adult and continuously from the shoulder blades to the waist of the adult, g. at least one cut-out portion formed in adjacent and spaced relation from and communicating with the said second transverse end, said one cut-out portion being dimensioned to surround the neck of the infant, and h. said aperture and said one cut-out portion disposed a sufficient spaced distance from one another for concurrent and respective engagement with the necks of the adult and of the infant, and in covering relation to frontal portions of both when the adult holds the infant during feeding.

2. An assembly as in claim 1 wherein the length of said first portion is lesser than the length of said second portion, and a transverse dimension of said base between opposite longitudinal sides being substantially constant throughout the length of said base.

3. A structure as in claim 1 comprising an elongated slit formed in said base and extending from said aperture to said second transverse end along the length of said second portion.

4. A structure as in claim 3 wherein said slit is disposed to divide said second portion into said panels disposable in adjacent side-by-side relation to one another and moveable relative to one another,

5. A structure as in claim 4 wherein each of said panels comprises an end portion, said end portions collectively defining said second transverse end and said end portions separated by one end of said slit, each end portion comprising a cut-out portion dimensioned and configured to engage and surround a neck of a child being held by the adult.

6. A structure as in claim 5 wherein each cut-out portion and respective panel is disposed to engage and at least partially cover a baby held on a different and corresponding side of the adult.

7. An assembly as in claim 6 wherein said slit extends along a longitudinal center of said second portion and said panels are of substantially equal dimension and configuration.

8. An assembly as in claim 1 wherein said base is formed of an absorbent first layer defining an outer face of said base and a second layer of substantially liquid impermeable material secured to an underlying said first layer.

* * * * *